US006532906B1

(12) United States Patent
Knoeppel et al.

(10) Patent No.: US 6,532,906 B1
(45) Date of Patent: Mar. 18, 2003

(54) INLET HEAT RECOVERY MODULE FOR WATER HEATER

(75) Inventors: Ray O. Knoeppel, Hartland, WI (US); Marc W. Akkala, Cedarburg, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 10/122,032

(22) Filed: Apr. 12, 2002

(51) Int. Cl.[7] ..... F24H 9/20

(52) U.S. Cl. ..... 122/14.3; 122/14.31; 122/13.3; 122/19.1; 137/337

(58) Field of Search ..... 122/14.3, 14.31, 122/13.3, 19.1; 137/337; 237/66

(56) References Cited

U.S. PATENT DOCUMENTS

| | | | | |
|---|---|---|---|---|
| 2,500,621 A | | 3/1950 | Tidd | |
| 3,244,166 A | | 4/1966 | Miller | |
| 3,316,894 A | | 5/1967 | Ramey et al. | |
| 4,286,573 A | | 9/1981 | Nickel | |
| 4,549,525 A | | 10/1985 | Narang | |
| 4,664,096 A | | 5/1987 | Narang | |
| 4,964,394 A | | 10/1990 | Threatt | |
| 5,029,605 A | * | 7/1991 | Dowling et al. | 122/14.3 |
| 5,584,316 A | * | 12/1996 | Lund | 122/13.3 |
| 5,586,572 A | * | 12/1996 | Lund | 122/13.3 |

FOREIGN PATENT DOCUMENTS

| | | | |
|---|---|---|---|
| DE | 2260395 | * | 12/1972 |
| GB | 2186678 A | * | 8/1987 |
| GB | 2238104 A | * | 5/1991 |

OTHER PUBLICATIONS

10 CFR Ch. II, Pt. 430, Subpt. B, App. E, published by Office of the Federal Register National Archives and Records Administration, published Jan. 1, 2001, pp. 149–152, Figures 1–7.

* cited by examiner

*Primary Examiner*—Jiping Lu
(74) *Attorney, Agent, or Firm*—Michael Best & Friedrich LLP

(57) ABSTRACT

A water heater includes a storage tank communicating with a cold water supply pipe and a hot water supply pipe for the respective supply of cold water to, and removal of hot water from, the tank. The water heater also includes an insulated heat recovery module communicating between the cold water supply pipe and the tank. The heat recovery module defines a cavity, and the cold water supply pipe communicates with a lower portion of the cavity. The heat recovery module has a smaller surface area-to-volume ratio than the cold water supply pipe. When water in the tank is heated, some water is thermally displaced from the tank and into the cavity. Consequently, water is displaced out of the lower portion of the cavity and into the cold water supply pipe. Therefore, only the coldest water is displaced out of the cavity, and thermal energy loss is reduced.

31 Claims, 2 Drawing Sheets

INLET HEAT RECOVERY MODULE FOR WATER HEATER

BACKGROUND

The invention relates to a heat recovery module for a water heater.

In known storage-type water heaters, water in a holding tank is heated during standby such that the water is of a suitable temperature during draws. The water expands as it is heated, which causes some of the water to be displaced out of the tank and into the cold water supply pipe. Thermal energy in the displaced water is lost as the displaced water cools in the cold water supply pipe.

One solution to the loss of thermal energy during displacement is to insulate a length of the cold water supply pipe. This solution has its limitations, however. Because of the relatively small diameter of most cold water supply pipes, the surface area-to-volume factor or ratio of the cold water supply pipe is relatively large (on the order of 5 inches squared/inches cubed). A large surface area-to-volume factor hinders the effective insulation of the pipe. Also, cold water supply pipes typically extend vertically from the water heater, and therefore facilitate thermal transfer from the hot water at the bottom of the pipe to the cold water in the pipe under the influence of natural convection currents, even if the pipe is insulated. Also, in a typical ten gallon draw, the amount of water that will be forced from the tank due to the subsequent thermal expansion is equivalent to approximately one pint. In the case of a ¾ inch cold water supply pipe, displacement of one pint of water would require the insulation of more than five feet of the cold water supply pipe.

SUMMARY

The invention provides a water heater comprising a storage tank for holding water, a heating device for heating the water in the tank, a hot water outlet communicating between the tank and a hot water supply pipe, and a cold water inlet communicating between the tank and a cold water supply pipe. Preferably, the inlet includes a dip tube extending to the lower portion of the tank and communicating with the cold water supply pipe. The invention also provides a heat recovery module having an interior cavity that communicates between the dip tube and the cold water supply pipe. The heat recovery module preferably includes insulation surrounding the cavity. The surface area-to-volume ratio of the cavity is smaller than the surface area-to-volume ratio of the cold water supply pipe.

As cold water is heated within the tank, the water expands and forces some of the water out of the tank and into the cavity of the heat recovery module. Water in the cavity naturally stratifies such that the warmest water rises to the upper portion of the cavity and the coldest water sinks to the lower portion of the cavity. The cold water supply pipe communicates with the lower portion of the cavity such that, as the water expands into the heat recovery module, only the coldest water in the cavity is displaced into the cold water supply pipe.

Other features and advantages of the invention will become apparent to those skilled in the art upon review of the following detailed description, claims, and drawings.

Figure 1:
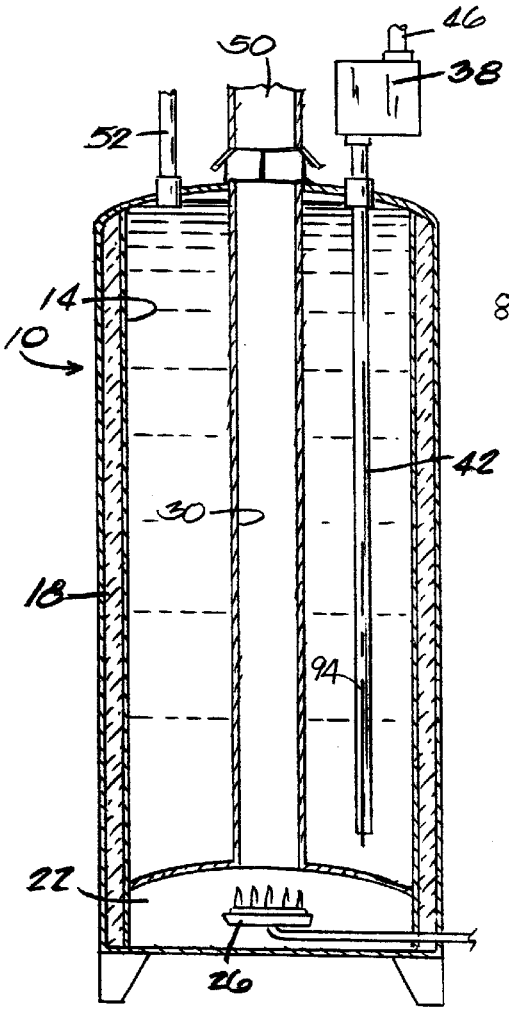
FIG. 1 is a cross-section view of a water heater embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a water heater 10 that includes a storage tank 14 for containing water, an insulation jacket 18 surrounding the tank 14, a combustion chamber 22 beneath the storage tank 14, a gas burner 26 in the combustion chamber 22, a flue 30 communicating with the combustion chamber 22 and extending up through the storage tank 14, a heat recovery module 38, and a dip tube 42 communicating with the heat recovery module 38. A cold water supply pipe 46 communicates with the heat recovery module 38 and supplies cold water to the storage tank 14 through the dip tube 42. The heat recovery module 38 communicates with the tank 14 only through the dip tube 42, and the cold water supply pipe 46 communicates with the tank 14 only through the heat recovery module 38. Head pressure forces the cold water in the supply pipe 46 into the tank 14.

When activated, the burner 26 creates products of combustion which flow under the influence of convection up through the flue 30. The hot products of combustion heat the water in the tank 14 through the flue walls 30, and are then vented through a ventilation stack 50. As the water is heated, it naturally stratifies or stacks such that the hottest water is at the top of the tank 14 and the coldest water is at the bottom.

It should be noted that, although the illustrated water heater 10 is a gas-fired water heater, the invention may be embodied in an electric water heater. Electric water heaters do not require a flue 30 because there are no products of combustion to vent. Rather, electric water heaters employ an electrically-powered heating element that is submerged in the water in the tank 14. In this regard, the term "heating device" should be interpreted to mean a gas burner, an electric heating element, or any other means for heating the water in the tank 14.

A hot water supply pipe 52 communicates between the water heater 10 and a hot water faucet or valve (not shown). When the hot water faucet is opened, cold water is forced into the bottom of the tank 14 through the dip tube 42 due to the head pressure. At the same time, hot water from the top of the storage tank 14 is displaced out of the tank 14 into the hot water supply pipe 52. When the faucet is shut, the flow of water out of the tank 14 through the hot water supply pipe 52 is ceased, and the water in the tank 14 is again heated by the burner 26.

As the water is heated, it expands, which causes thermal displacement or expansion of water from the tank 14. Because the faucet is shut, the water cannot expand into the hot water supply pipe 52. Instead, the expanding water overcomes the head pressure and expands into the heat recovery module 38, which in turn forces water out of the heat recovery module 38 and into the cold water supply pipe 46. The water that exits the tank 14 due to expansion travels through the inlet water connection of the tank 14, i.e., where the dip tube 42 connects to the tank 14.

Figure 2:
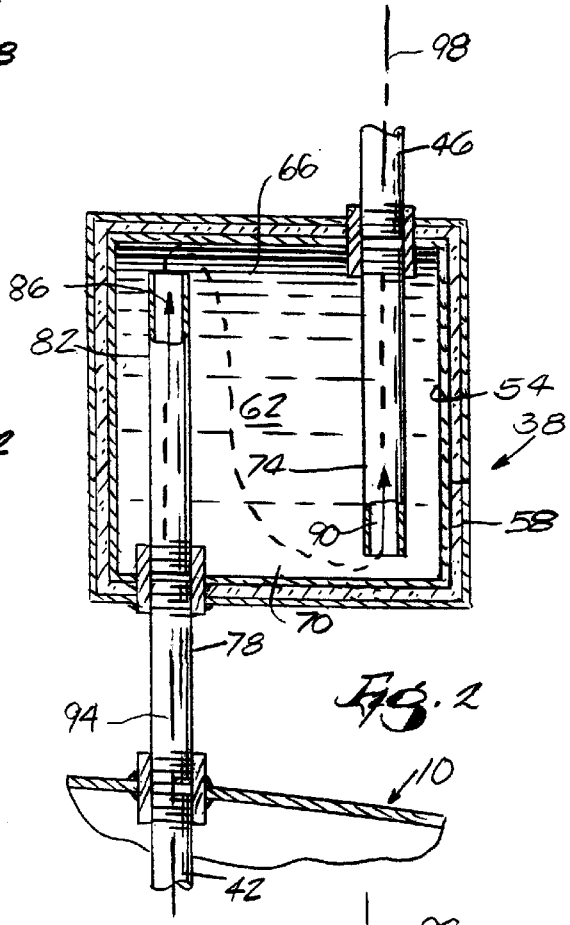
FIG. 2 is an enlarged cross-section view of the heat recovery module of the water heater.
Figure 3:
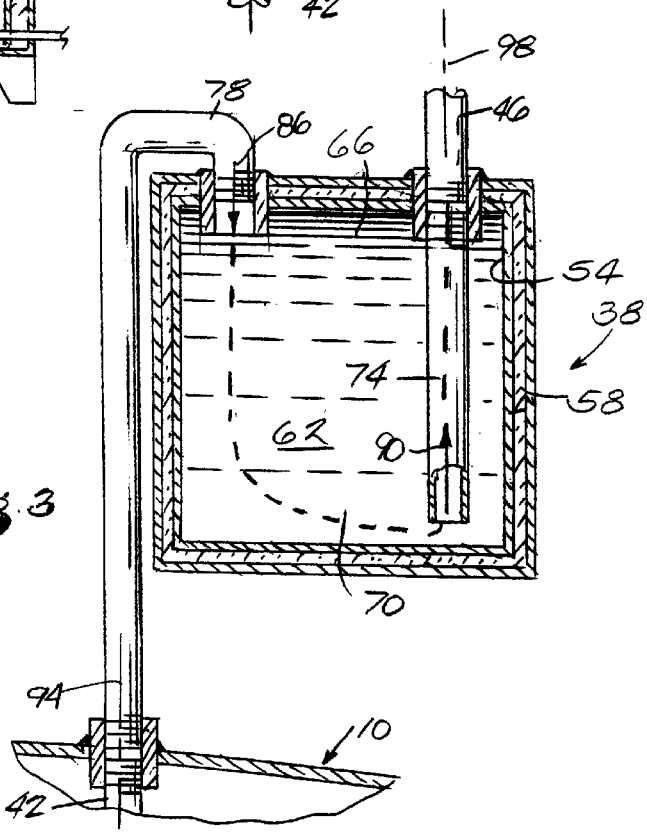
FIG. 3 is an enlarged cross-section view of an alternative construction of the heat recovery module.

Turning to FIGS. 2 and 3, the heat recovery module 38 includes a canister 54 that is surrounded by insulation 58. The heat recovery module 38 defines an interior cavity 62 that has an upper portion 66 and a lower portion 70. A module inlet tube 74 communicates with the cold water supply pipe 46 and extends to the lower portion 70 of the cavity 62. Alternatively, the cold water supply pipe 46 may extend through the top of the module 38, or any other wall of the module 38, and extend into the cavity 62 to the lower portion 70 thereof, thereby eliminating the need for the module inlet tube 74.

Figure 4:
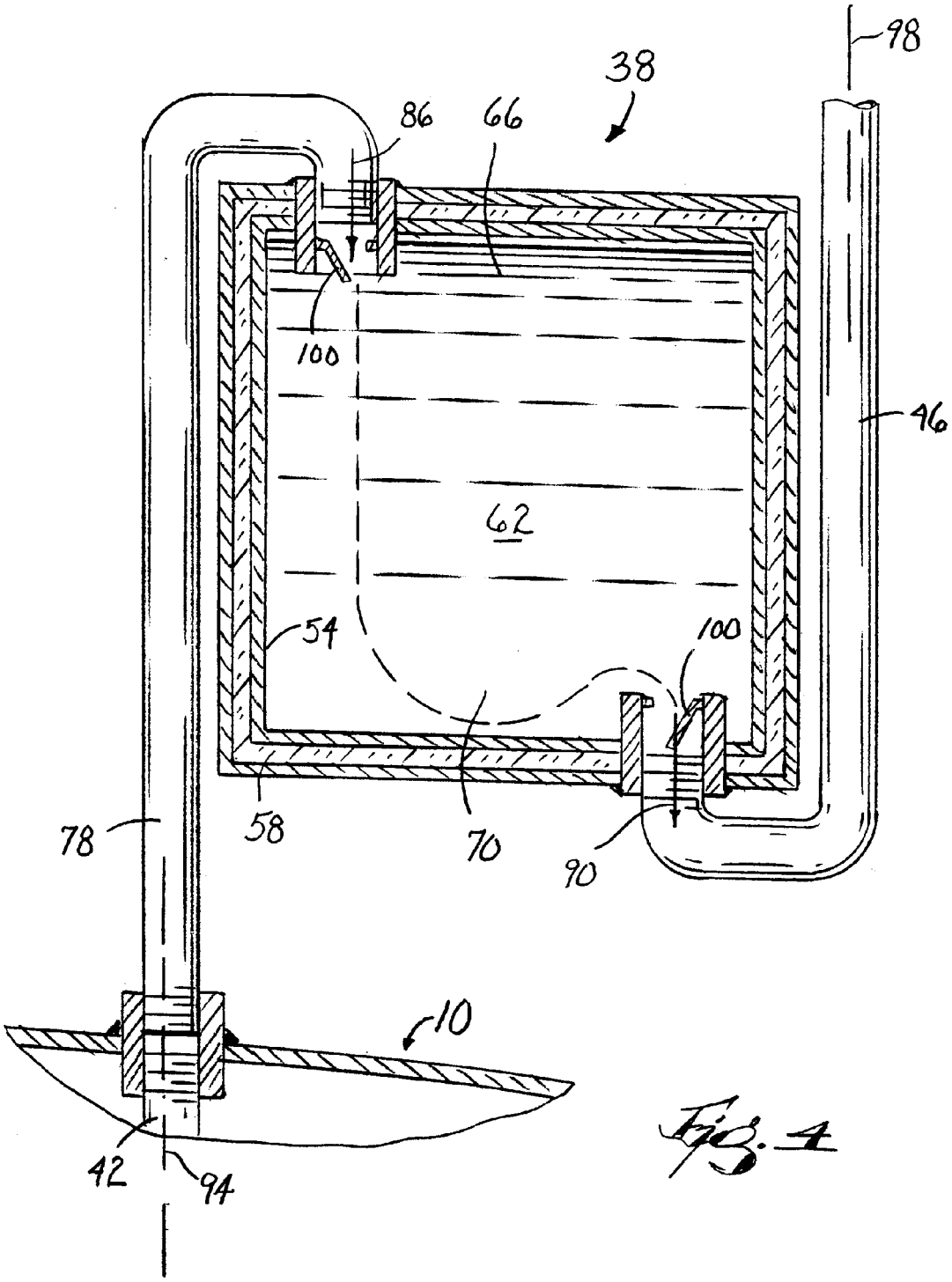
FIG. 4 is an enlarged cross-section view of another construction of the heat recovery module.

FIGS. 1 and 2 illustrate an in-line construction of the module 38 and FIG. 3 illustrates a top entry construction of the module 38. In the top entry construction, a connecting pipe 78 extends through the top of the canister 54 and communicates directly between the upper portion 66 of the cavity 62 and the water heater dip tube 42. In the in-line construction, the connecting pipe 78 extends through the bottom of the canister 54 and communicates between the dip tube 42 and a module outlet tube 82 that extends up into the upper portion 66 of the cavity 62. Alternatively, the connecting pipe 78 may extend through the bottom of the module 38, or any other wall of the module 38, and extend into the cavity 62 to the upper portion 66 thereof, thereby eliminating the need for the module outlet tube 82. As shown in FIG. 4, the cold water supply pipe 46 can be configured to extend through the bottom of the heat recovery module 38 and thereby communicate directly with the lower portion 70 of the cavity 62. It will become apparent to those of skill in the art that many other constructions are possible for the module 38, and that the invention is not limited to the constructions illustrated.

As it does in the water storage tank 14, water naturally stratifies or stacks within the heat recovery module 38 such that the warmest water rises to the upper portion 66 of the cavity 62 and the coldest water sinks to the lower portion 70 of the cavity 62. When water is forced out of the storage tank 14 due to thermal displacement as discussed above, the coldest water in the heat recovery module 38 (i.e., the water in the lower portion 70 of the cavity 62) is displaced out of the cavity 62 and into the cold water supply pipe 46 through the module inlet tube 74. In this way, the warmest water in the heat recovery module 38 is maintained within the heat recovery module 38, and heat loss is reduced.

The insulation 58 surrounding the canister 54 further reduces heat loss out of the heat recovery module 38. The heat recovery module 38 is advantageous over simply applying insulation to the cold water inlet pipe 46 because the canister 54 has a much smaller surface area-to-volume factor or ratio than the cold water supply pipe 46. The surface area-to-volume factor for the canister 54 is preferably about 1.3 inches squared/inches cubed. Although, the surface area-to-volume factor for the canister 54 is preferably about 26% of the surface area-to-volume factor of the cold water supply pipe 46, any percentage less than 75% produces a significant heat loss reduction. The connecting pipe 78 is preferably six inches or less in length (in the in-line construction of FIG. 2) to minimize its exposed surface area and to ensure that water being forced out of the storage tank 14 quickly passes into the insulated canister 54. As a further measure to reduce loss of energy, the connecting pipe 78 may be insulated.

It should also be noted that, in the constructions illustrated, the direction 86 in which the water enters the cavity 62 upon thermal displacement is non-collinear with the direction 90 in which the water exits the cavity 62 upon thermal displacement. In the illustrated constructions, the longitudinal axis 94 of the dip tube 42 is non-collinear with the longitudinal axis 98 of the cold water supply pipe 46.

The displaced water therefore does not merely move vertically out of the tank 14 and directly into the cold water supply pipe 46, but rather must follow a generally N-shaped or U-shaped flow path (see the broken lines in FIGS. 2 and 3, respectively) from the connecting pipe 78 to the cold water supply pipe 46. An N-shaped, U-shaped, or substantially any other tortuous, curved, or arcuate flow path helps to reduce thermal transfer from the relatively warm water displaced from the tank to the cold water in the cold water supply pipe under the influence of natural convection currents.

It should also be noted that heat traps 100 can be added to one or both of the connection points of the heat recovery module 38 to further increase the efficiency of the water heater. For example, as shown in FIG. 4, a heat trap 100 can be positioned at the end of the connecting pipe 78 adjacent to the heat recovery module 38, and another heat trap 100 can be positioned at the end of the cold water supply pipe 46 adjacent the heat recovery module 38. The heat traps 100 can be a flap-type heat trap (as illustrated), a ball-type heat trap, or any other type of heat trap that is well known to those skilled in the art. Although not illustrated, the heat traps 100 can be positioned anywhere along connecting pipe 78 or cold water supply pipe 46, and the addition of heat traps 100 is not limited to the construction illustrated in FIG. 4.

What is claimed is:

1. A water heater comprising:

a storage tank for holding water, said storage tank adapted to communicate with a cold water supply pipe and with a hot water outlet pipe for the respective supply of cold water to, and removal of hot water from, said tank, the cold water supply pipe being characterized by a surface area-to-volume ratio;

a heating device adapted to heat the water in said tank, and to thereby cause expansion of the water in said tank; and a heat recovery module defining an interior cavity communicating between said storage tank and the cold water supply pipe, the cold water supply pipe communicating directly with a lower portion of said cavity, said cavity being characterized by a surface area-to-volume ratio that is smaller than the surface area-to-volume ratio of the cold water supply pipe;

wherein expansion of the water in said tank during heating causes thermal displacement of water out of said tank and into said cavity, and causes thermal displacement of water from said lower portion of said cavity and into the cold water supply pipe.

2. The water heater of claim 1, further comprising a dip tube communicating directly between said cavity and a lower portion of said tank, wherein said thermal displacement forces water from said lower portion of said tank and into said cavity.

3. The water heater of claim 1, wherein said heat recovery module includes a module inlet tube extending through a wall of said heat recovery module and into said cavity, said module inlet tube communicating directly between the cold water supply pipe and said lower portion of said cavity.

4. The water heater of claim 1, further comprising a connecting pipe communicating directly between an upper portion of said cavity and said tank.

5. The water heater of claim 4, wherein said connecting pipe extends through the top of said heat recovery module.

6. The water heater of claim 4, wherein said connecting pipe extends through the bottom of said heat recovery module, said water heater further comprising a module outlet tube extending through a wall of said heat recovery module and into said cavity, said module outlet tube communicating directly between said connecting pipe and said upper portion of said cavity.

7. The water heater of claim 4, wherein said connecting pipe extends through the bottom of said heat recovery module and extends to said upper portion of said cavity.

8. The water heater of claim 4, further comprising a dip tube communicating directly between said connecting pipe and a lower portion of said water heater tank.

9. The water heater of claim 8, wherein said tank and cavity communicate with each other only through said dip tube.

10. The water heater of claim 4, wherein said connecting pipe is not more than six inches in length.

11. The water heater of claim 1, wherein said heat recovery module includes insulation surrounding said cavity.

12. The water heater of claim 1, wherein the directions of water flow into and out of said cavity due to said thermal displacement are non-collinear with each other.

13. The water heater of claim 1, wherein said tank and cold water supply pipe communicate with each other only through said heat recovery module.

14. The water heater of claim 1, wherein said surface area-to-volume ratio of said heat recovery module is less than 75 percent of the surface area-to-volume ratio of the cold water supply pipe.

15. The water heater of claim 1, wherein the cold water supply pipe extends through the bottom of said heat recovery module.

16. The water heater of claim 1, further comprising a heat trap interposed between the tank and the cold water supply pipe such that all water flowing between said tank and the cold water supply pipe passes through said heat trap.

17. A heat recovery module adapted to communicate between a cold water supply pipe and a storage-type water heater, the cold water supply pipe being characterized by a surface area-to-volume ratio, the module comprising:

a cavity having an upper portion and a lower portion, and being characterized by a surface area-to-volume ratio that is smaller than the surface area-to-volume ratio of the cold water supply pipe;

an inlet communicating directly between the cold water supply pipe and said lower portion of said cavity; and a connecting pipe communicating between said cavity and the storage-type water heater;

wherein expansion of the water in the water heater during heating causes thermal displacement of water out of the water heater and into said heat recovery module, and causes thermal displacement of water from said lower portion of said cavity and into the cold water supply pipe.

18. The module of claim 17, further comprising insulation surrounding said cavity.

19. The module of claim 17, wherein said connecting pipe communicates directly with said upper portion of said cavity.

20. The module of claim 19, wherein said connecting pipe extends through the top of said cavity.

21. The module of claim 19, wherein said connecting pipe extends through the bottom of said cavity, said module further comprising a module outlet tube communicating directly between said upper portion of said cavity and said connecting pipe.

22. The module of claim 19, wherein said connecting pipe extends through the bottom of said cavity and extends to the upper portion of said cavity.

23. The module of claim 19, wherein said connecting pipe is adapted to communicate with a dip tube in the water heater, the dip tube communicating directly with a lower portion of the water heater.

24. The module of claim 19, wherein said connecting pipe is less than about six inches in length.

25. The module of claim 17, wherein the directions of water flow into and out of said cavity due to said thermal displacement are non-collinear with each other.

26. The module of claim 17, wherein said inlet includes a module inlet tube extending through a wall in said cavity and extending into said cavity, said module inlet tube communicating directly between the cold water supply pipe and said lower portion of said cavity.

27. The module of claim 26, wherein said cavity is adapted to communicate with the cold water supply pipe only through said module inlet tube.

28. The module of claim 17, wherein the cold water supply pipe extends through the bottom of said cavity.

29. The module of claim 17, further comprising a heat trap interposed between the tank and the cold water supply pipe such that all water flowing between said tank and the cold water supply pipe passes through said heat trap.

30. A water heater comprising:

a storage tank for holding water, said storage tank adapted to communicate with a cold water supply pipe and with a hot water outlet pipe for the respective supply of cold water to, and removal of hot water from, said tank, the cold water supply pipe being characterized by a surface area-to-volume ratio;

a heating device adapted to heat the water in said tank, and to thereby cause expansion of the water in said tank; and a heat recovery module defining an interior cavity communicating between said storage tank and the cold water supply pipe, the cold water supply pipe communicating with a lower portion of said cavity, said cavity being characterized by a surface area-to-volume ratio that is smaller than the surface area-to-volume ratio of the cold water supply pipe;

wherein expansion of the water in said tank during heating causes thermal displacement of water out of said tank and into said cavity, and causes thermal displacement of water from said lower portion of said cavity and into the cold water supply pipe, and wherein the directions of water flow into and out of said cavity due to said thermal displacement are non-collinear with each other.

31. A heat recovery module adapted to communicate between a cold water supply pipe and a storage-type water heater, the cold water supply pipe being characterized by a surface area-to-volume ratio, the module comprising:

a cavity having an upper portion and a lower portion, and being characterized by a surface area-to-volume ratio that is smaller than the surface area-to-volume ratio of the cold water supply pipe;

an inlet communicating between the cold water supply pipe and said lower portion of said cavity; and a connecting pipe communicating between said cavity and the storage-type water heater;

wherein expansion of the water in the water heater during heating causes thermal displacement of water out of the water heater and into said heat recovery module, and causes thermal displacement of water from said lower portion of said cavity and into the cold water supply pipe, and wherein the directions of water flow into and out of said cavity due to said thermal displacement are non-collinear with each other.

* * * * *